US011698042B2

(12) United States Patent
Zhou et al.

(10) Patent No.: US 11,698,042 B2
(45) Date of Patent: Jul. 11, 2023

(54) UNIQUE BLOCK RIB GEOMETRY FOR REDUCING LINER DISTORTION

(71) Applicant: Cummins Inc., Columbus, IN (US)

(72) Inventors: Xiling Zhou, Hubei Province (CN); Vijaysai Karuppiah Kumareshan, Columbus, IN (US); John Jerl Purcell, III, Louisa, VA (US); Mathew A. Clark, Darlington (GB)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/351,438

(22) Filed: Jun. 18, 2021

(65) Prior Publication Data

US 2021/0324816 A1 Oct. 21, 2021

Related U.S. Application Data

(63) Continuation of application No. PCT/US2019/066271, filed on Dec. 13, 2019.
(Continued)

(51) Int. Cl.
*F02F 7/00* (2006.01)
*F02F 1/00* (2006.01)

(52) U.S. Cl.
CPC ..... *F02F 7/0021* (2013.01); *F02F 1/004* (2013.01); *F02F 7/0065* (2013.01); *F02F 2001/008* (2013.01)

(58) Field of Classification Search
CPC ..... F02F 7/0021; F02F 7/0065; F02F 1/18; F02F 1/163; F02F 1/004; F02F 2001/008; F16J 10/04
See application file for complete search history.

(56) References Cited

U.S. PATENT DOCUMENTS 3,568,573 A 3/1971 Bailey et al.
3,977,385 A 8/1976 Mansfield
(Continued)

FOREIGN PATENT DOCUMENTS

DE 102005048537 A1 4/2007
EP 2290216 3/2011
(Continued)

OTHER PUBLICATIONS

International Search Report and Written Opinion, PCT Appln. No. PCT/US19/66271, dated Mar. 4, 2020, 11 pgs.
(Continued)

*Primary Examiner* — Grant Moubry
(74) *Attorney, Agent, or Firm* — Taft Stettinius & Hollister LLP

(57) ABSTRACT

An engine block includes one or more cylinder bores wherein each cylinder bore is surrounded by a cylinder bore wall. The cylinder bore wall includes a liner stop mechanism to locate a liner in the cylinder bore. The cylinder bore includes a mid-portion that spans between an upper end and a lower end, wherein the liner stop mechanism can be located near the upper end, near the lower end, or the mid-portion. The engine block has an outer cylinder block wall that is exterior to the cylinder bore wall. The outer cylinder block wall includes a first rib positioned above the liner stop mechanism and a second rib positioned below the liner stop mechanism relative to a cylindrical axis of the cylinder bore. The first and second ribs straddle the liner stop mechanism to reduce rotation and buckling of the liner during operation of the engine.

18 Claims, 7 Drawing Sheets

Related U.S. Application Data

(60) Provisional application No. 62/781,943, filed on Dec. 19, 2018.

(56) References Cited

U.S. PATENT DOCUMENTS 4,016,850 A * 4/1977 Bloemers ..... F02F 1/04 123/193.2
4,244,330 A * 1/1981 Baugh ..... F01M 11/02 123/193.2
4,440,118 A * 4/1984 Stang ..... F01P 3/02 123/41.42
4,523,555 A * 6/1985 Mezger ..... F01P 3/02 123/193.3
5,357,921 A * 10/1994 Katoh ..... F02F 7/008 123/193.2
5,404,847 A 4/1995 Han
5,651,340 A 7/1997 Schwaderlapp et al.
5,669,346 A 9/1997 Leweux et al.
5,887,558 A * 3/1999 Kampichler ..... F02F 1/045 123/193.2
5,979,374 A * 11/1999 Jackson ..... F02F 1/163 123/193.2
5,983,975 A 11/1999 Nilsson
6,044,821 A * 4/2000 Weng ..... F02F 1/16 123/193.2
6,976,466 B2 12/2005 Gibisch et al.
7,322,320 B2 1/2008 Sugano
8,408,178 B2 4/2013 Xu et al.
10,107,228 B2 * 10/2018 Sharma ..... F02F 1/163
2004/0244758 A1 * 12/2004 Weng ..... F02F 1/18 29/888.011
2006/0037566 A1 * 2/2006 Sugano ..... F16C 9/02 123/41.74
2007/0240672 A1 10/2007 Furuya
2008/0245320 A1 * 10/2008 Ishikawa ..... F02F 1/108 123/41.74
2013/0263812 A1 * 10/2013 Geyer ..... F02F 7/0004 123/193.2
2016/0273480 A1 9/2016 Purcell et al.
2016/0290276 A1 10/2016 Nicosia et al.
2021/0310439 A1 10/2021 Zhou et al.

FOREIGN PATENT DOCUMENTS

GB 2143899 A 2/1985
JP 2006002602 1/2006
WO 2005068814 7/2005
WO 2016159970 10/2016

OTHER PUBLICATIONS

European Extended Search Report, Counter EP Appln. No. 19899832.0, Jun. 3, 2022, 6 pgs., 6.

* cited by examiner

UNIQUE BLOCK RIB GEOMETRY FOR REDUCING LINER DISTORTION

CROSS-REFERENCE TO RELATED APPLICATION

The present application is a continuation of International Patent App. No. PCT/US2019/66271 filed on Dec. 13, 2019, which claims the benefit of the filing date of U.S. Provisional Application No. 62/781,943 filed on Dec. 19, 2018, each of which is incorporated herein by reference.

TECHNICAL FIELD

The present application relates generally to cylinder block walls for an internal combustion engine, and more particularly to a feature on the cylinder block walls partially surrounding a cylinder liner.

BACKGROUND

Internal combustion engines include one or more cylinders wherein each cylinder includes a piston in the cylinder bore. During the combustion cycle, the piston moves in an upstroke direction and a downstroke direction relative to the cylinder bore. Cylinder walls of the cylinder bore can become very worn or damaged from use. If the engine is not equipped with replaceable sleeves, there is a limit to how far the cylinder walls can be bored or worn before the block must be sleeved or replaced.

Cylinder wall thickness is important to efficient thermal conductivity in the engine. When choosing sleeves, engines have specifications to how thick the cylinder walls should be to prevent overworking the coolant system. Each engine's needs are different, dependent on designed work load duty cycle and energy produced.

A cylinder liner is a cylindrical part to be fitted into an engine block to form a cylinder. The cylinder liner, serving as the inner wall of a cylinder, forms a sliding surface for the piston rings while retaining the lubricant within. The cylinder liner receives combustion heat through the piston and piston rings and transmits the heat to the coolant. The cylinder liner prevents the compressed gas and combustion gas from escaping outside. The cylinder liner should be designed such that it is hard to transform by high pressure and high temperature in the cylinder bore.

During operation of the piston in the combustion cycle, a liner seat of the cylinder liner can rotate which can cause the liner to buckle under load in the direction of the liner axis. Moreover, the liner can buckle due to loads from cylinder pressure or thermal expansion. If the liner is installed using press-fit or transitional fit techniques which can close under thermal or pressure related expansion, then the liner may rotate about the cylinder axis or expand which decreases the durability of the liner.

Therefore, further contributions in this area of technology are needed to improve the durability of the cylinder block walls of the engine. Therefore, there remains a significant need for the apparatuses, methods and systems disclosed herein.

SUMMARY

One embodiment is a unique system, method, and apparatus that includes an engine block for an internal combustion engine. The engine block includes one or more cylinder bores wherein each cylinder bore is surrounded by a cylinder bore wall. The cylinder bore wall includes a liner stop mechanism configured to locate a liner in the cylinder bore. The cylinder bore includes a mid-portion that spans between an upper end and a lower end, wherein the liner stop mechanism can be located near the upper end, near the lower end, or in the mid-portion of the cylinder bore. The engine block has an outer cylinder block wall that is exterior to the cylinder bore wall. The outer cylinder block wall includes a first rib positioned above the liner stop mechanism and a second rib positioned below the liner stop mechanism relative to a cylindrical axis of the cylinder bore. The first and second ribs straddle the liner stop mechanism and reduce rotation of the liner seat hence reducing the propensity of the liner to buckle under load in the direction of the cylindrical axis of the cylinder bore, or due to loads from cylinder pressure or thermal expansion. The first and second ribs also act to reduce rotation or expansion of the liner wall where the liner is in contact with the engine block due to press-fit, or transitional fits which tend to close under thermal or pressure related expansion. The reduction or suppression of the liner by the first and second ribs improves the piston ring conformability wherein ring conformability is a function of the distortion of the cylinder bore and piston ring's ability to bend to these distortions. The reduction or suppression of the liner by the first and second ribs also improves the oil consumption of the engine.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The concepts described herein are illustrative by way of example and not by way of limitation in the accompanying figures. For simplicity and clarity of illustration, elements illustrated in the figures are not necessarily drawn to scale. Where considered appropriate, references labels have been repeated among the figures to indicate corresponding or analogous elements.

DETAILED DESCRIPTION OF ILLUSTRATIVE EMBODIMENTS

Figure 1:
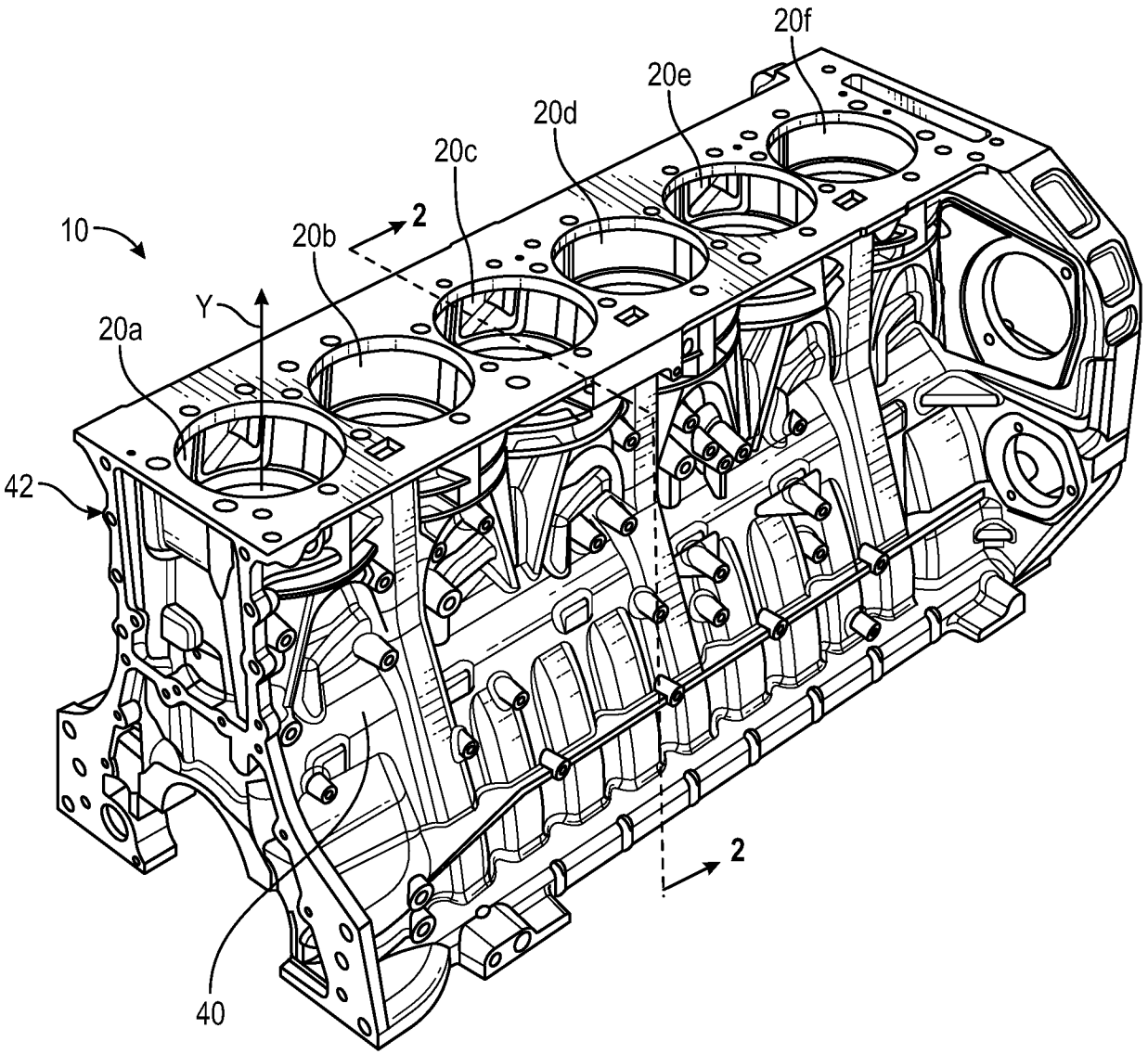
FIG. 1 is a perspective view of an engine assembly of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

A cylinder liner is a cylindrical part to be fitted into an engine block to form a cylinder. The cylinder liner, serving as the inner wall of a cylinder, forms a sliding surface for the piston rings while retaining the lubricant within. Some important functions of cylinder liners include an excellent sliding surface as well as high anti-galling properties, less wear on the cylinder liner itself, less wear on the partner piston ring, and less consumption of lubricant.

A cylinder liner or sleeve is installed by boring the cylinder to a size that is larger than normal inserted with an interference fit. Alternatively, the liners can be pressed into place, or they can be held in by a shrink fit. Cylinder wall thickness is important to efficient thermal conductivity in an internal combustion engine. When choosing sleeves, engines have specifications to how thick the cylinder walls should be to prevent overworking the coolant system. Each engine's needs are different, dependent on designed work load duty cycle and energy produced.

The cylinder liner receives combustion heat through the piston and piston rings and transmits the heat to the coolant. The cylinder liner prevents the compressed gas and combustion gas from escaping outside.

There are three types of liners such as the engine will have a bore in the base block or cylinder material, a dry liner which is a liner assembled into base block or cylinder without direct contact between coolant and liner, or wet liner which is a liner assembled into base block or cylinder with direct contact between coolant and liner.

Moreover, there are three liner types including top, mid and bottom stop. Generally, the cylinder head sealing surface is called the top end of the engine. The top-stop liner concept includes a flange on the top of the liner with which it is located into the cylinder block. The mid-stop has a similar flange at or near the middle of the liner, and the bottom stop has its locating flange near the lower end of the liner. In any of the top, mid, and bottom stop liner configurations, the cylinder bore of the engine block includes a liner stop mechanism that is configured to receive the liner.

Turning now to the present application with reference to FIG. 1, an engine block 10 for an internal combustion engine (not illustrated). The engine is an internal combustion engine of any type, and can include a stoichiometric engine, a gasoline engine, alcohol engine (e.g. ethanol or methanol), or a natural gas engine. In the illustrated embodiment, the engine block 10 includes and at least partially defines six cylinder bores 20*a*, 20*b*, 20*c*, 20*d*, 20*e*, and 20*f*, in an in-line arrangement. However, the number of cylinders may be any number, and the arrangement of cylinders may be any arrangement, and is not limited to the number and arrangement shown in FIG. 1.

Figure 2:
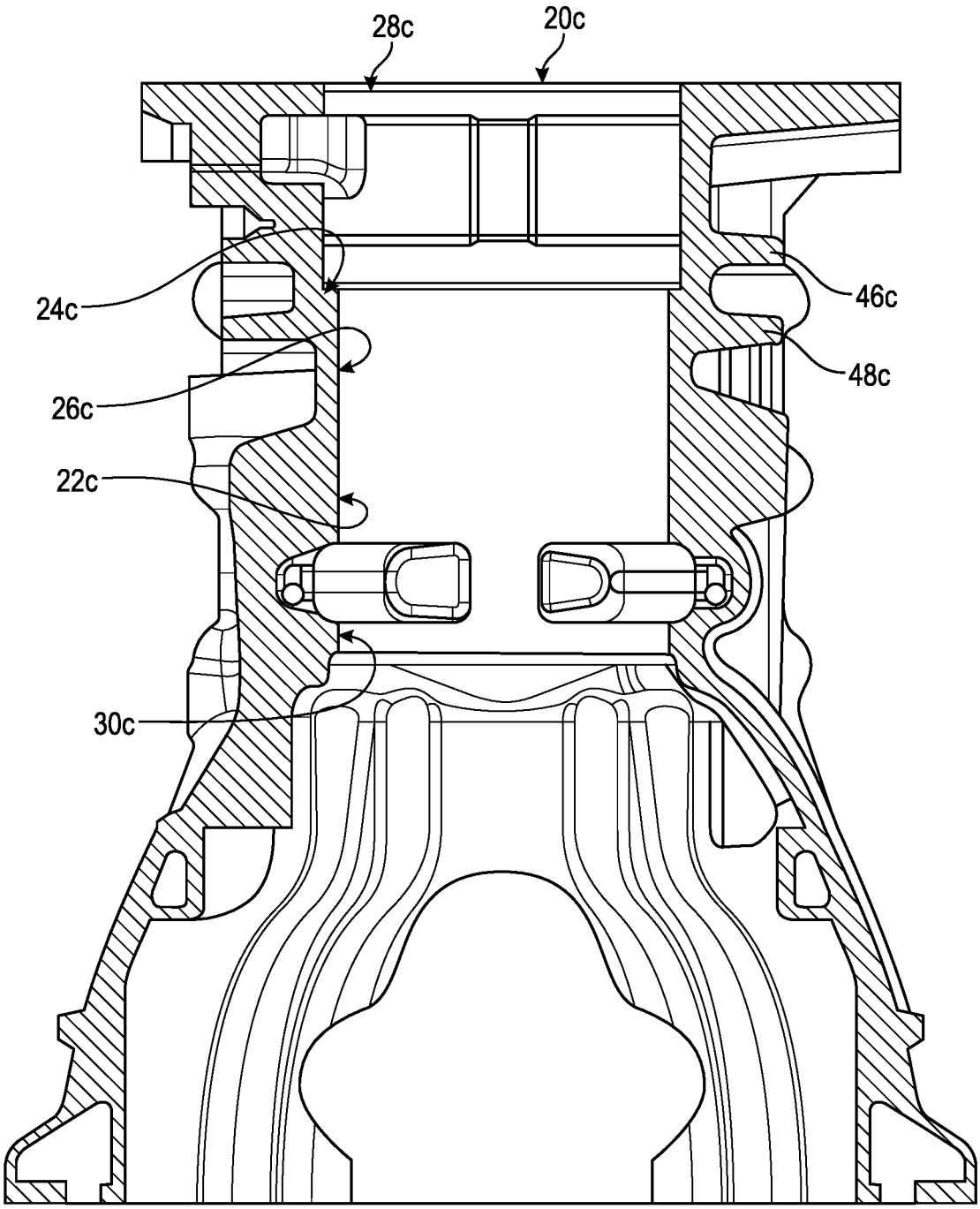
FIG. 2 is a cross-sectional view of the engine assembly of FIG. 1 of the present disclosure.
Figure 5:
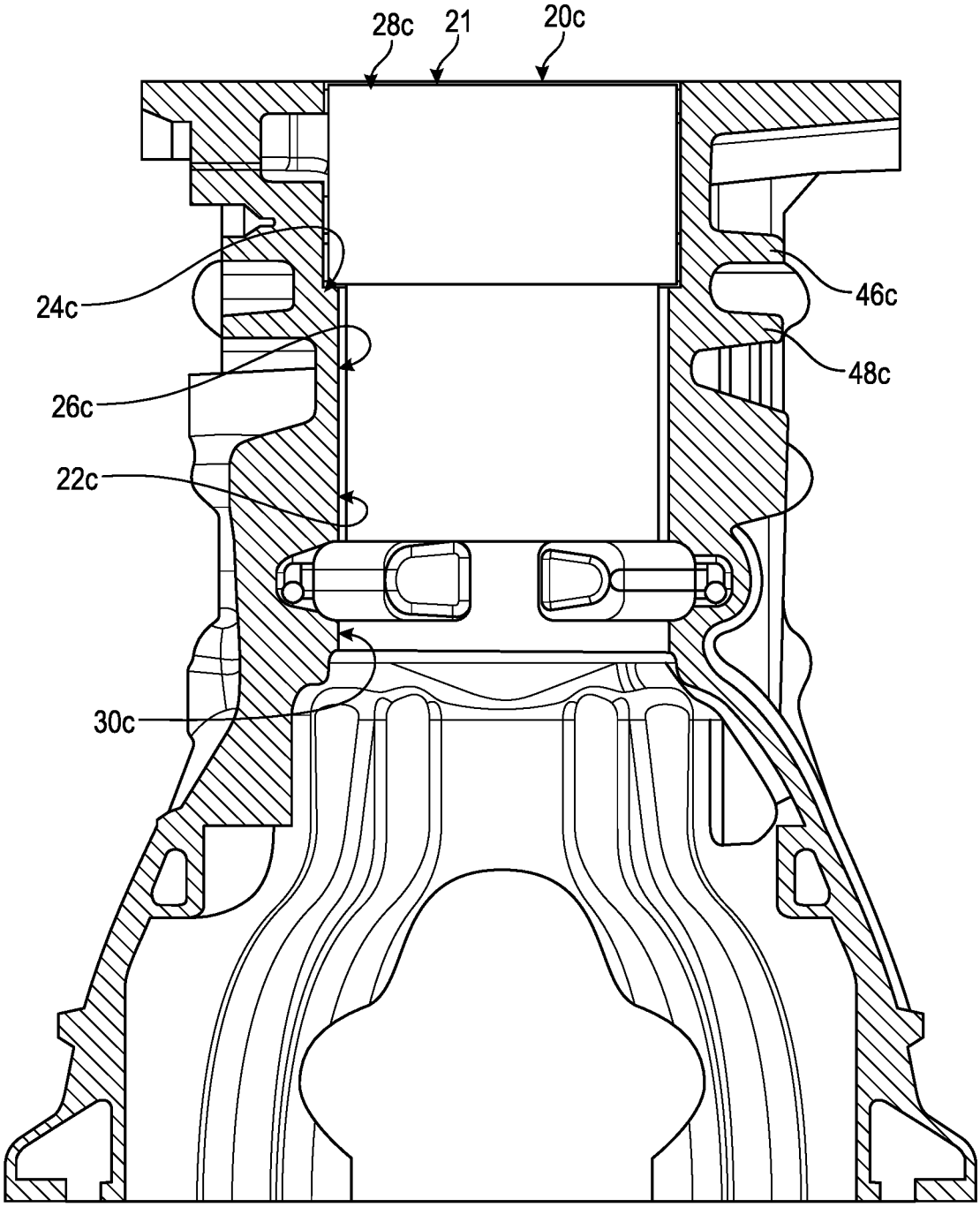
FIG. 5 is another view of FIG. 2 with one embodiment of a liner assembled in the cylinder bore of the present disclosure.
Figure 8:
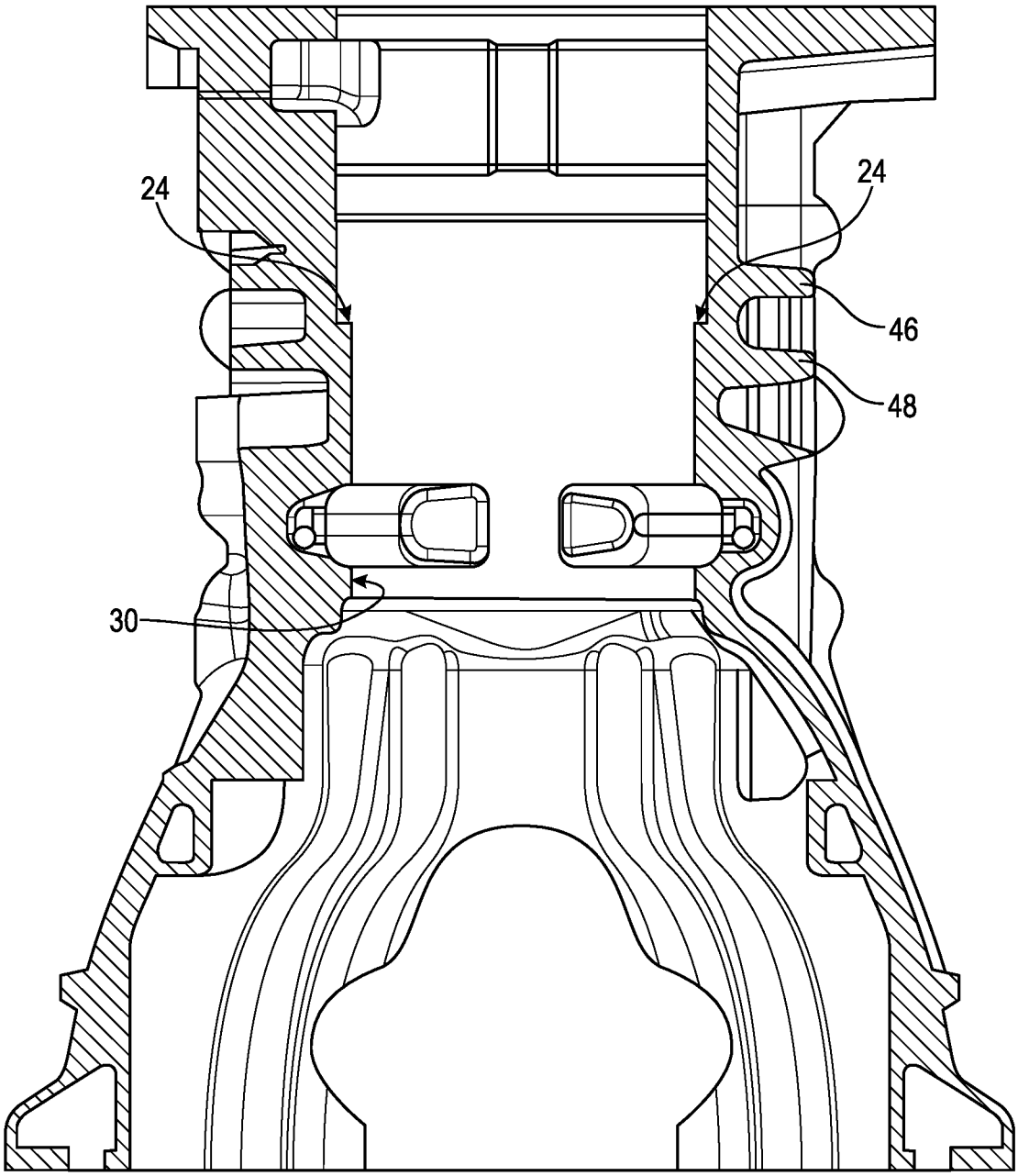
FIG. 8 is a cross-sectional view of one embodiment illustrating a liner stop mechanism being located near the lower end of the cylinder bore of the present disclosure.

One of the cylinder bores 20*c* will be described and the description is applicable for each of the cylinder bores 20*a*-20*f*, unless noted otherwise. As illustrated in FIG. 2, the cylinder bores 20*c* is surrounded by a cylinder bore wall 22*c*. The cylinder bore walls 22*c* includes a liner stop mechanism 24*c* configured to locate a liner or sleeve 21 in the cylinder bores 20*c* as illustrated in FIG. 5. The liner or sleeve 21 is illustrative of one type of liner that is described in the present application that can be assembled with the cylinder bore 20*c*. The liner stop mechanism 24*c* in the illustrated embodiment is a lip, ledge, flange, rim, projecting edge, ridge or other configuration in the cylinder bore wall 22*c*. In other embodiments, the liner stop mechanism 24*c* can be configured differently to engage and retain or support the liner 21 in the cylinder bore 20*c*. The cylinder bore wall 22*c* includes a mid-portion 26*c* that spans between an upper end 28*c* and a lower end 30*c*. A cylindrical axis Y spans between the upper and lower ends 28*c* and 30*c*. In the illustrated embodiment in FIG. 2, the liner stop mechanism 24 *c* is located in the mid-portion 26 *c* of the cylinder bore wall 22 *c*. Also illustrated in FIG. 2, the liner stop mechanism 24*c* is located near the upper end 28*c* of the cylinder bore 20*c*. In other embodiments, the liner stop mechanism 24*a, b, d-f* of cylinder bores 20*a*, 20*b*, and 20*d* f is located at or near either the upper end 28 or the lower end 30 of the respective cylinder bore walls 22*a*, 22*b*, 22*d*-22 *f*. Illustrated in FIG. 8, is an embodiment that illustrates the liner stop mechanism 24 located near the lower end 30.

Each of the cylinder bores 20 *a*-20 *f* is configured to receive the cylinder liner 21 to define a combustion chamber. A piston (not shown) may be slidably disposed within each of the liners 21 in the cylinder bores 20 *a*-20 *f* to reciprocate between a top-dead-center position and a bottom-dead-center position, and a cylinder head (not shown) may be associated with each of the cylinder bores 20 *a*-20 *f*. Each of the cylinder bores 20 *a*-20 *f*, its respective piston, and the cylinder head form a combustion chamber. In the illustrated embodiment, engine block 10 includes six such combustion chambers. However, it is contemplated that engine block 10 may include a greater or lesser number of cylinders and combustion chambers and that the cylinders and combustion chambers may be disposed in an "in-line" configuration, a "V" configuration, or in any other suitable configuration.

Cylinder liners may be inserted into cylinder bores 20*a*-20*f* under a variety of conditions. One such condition is a press fit, also known as an interference fit or friction fit, for example, creates an axial hold where adjoining parts share the same space by creating a slight elastic deformation and a compression force between the adjoining parts. Compression from the press fit increases the friction between the adjoining parts to a point where independent movement of the adjoining parts is not possible under normal operating conditions. Press fits between the cylinder liner and engine block 10 may be created using physical presses, principles of thermal expansion or other suitable method.

Figure 3:
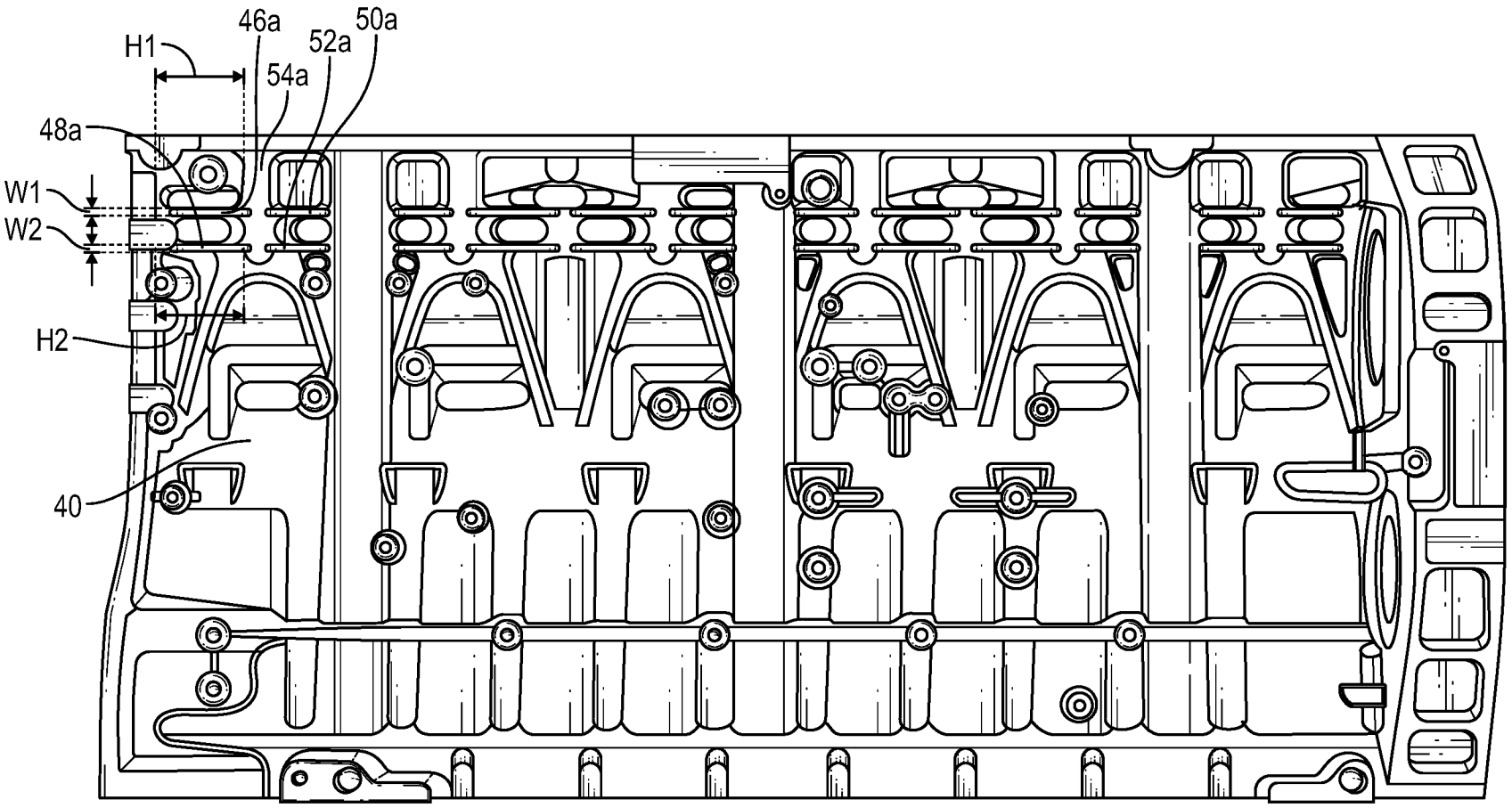
FIG. 3 is a right side view of the engine assembly of FIG. 1 of the present disclosure.
Figure 4:
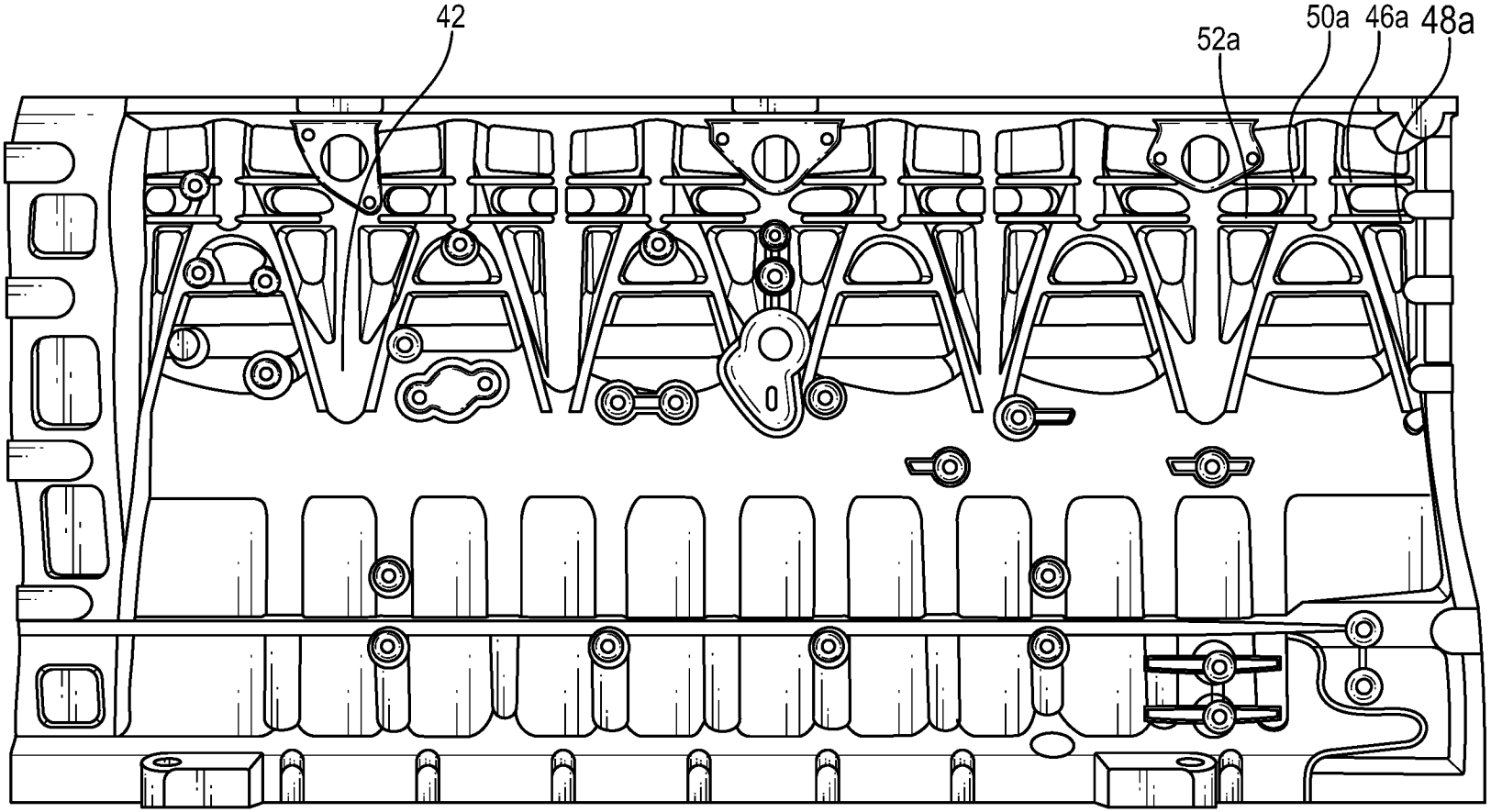
FIG. 4 is a left side view of the engine assembly of FIG. 1 of the present disclosure.

As illustrated in FIGS. 3 and 4, the engine block 10 includes a first outer cylinder block wall 40 opposite a second outer cylinder block wall 42 with the cylinders bores 20*a*-20*f* between the first and second outer cylindrical block walls 40 and 42. Each of the first and second outer cylinder block walls 40 and 42 surround at least a portion of the cylinder bore walls 22*a*-22*f*. The first outer cylinder block wall 40 includes a first rib 46*a* positioned above the liner stop mechanism 24*a* and a second rib 48*a* positioned below the liner stop mechanism 24*a* relative to the cylindrical axis Y of the cylinder bore 20*a*. In the illustrated embodiment, the first outer cylinder block wall 40 also includes a third rib 50*a* positioned above the liner stop mechanism 24 and a fourth rib 52*a* positioned below the liner stop mechanism 24*a* relative to the cylindrical axis Y of the cylinder bore

20*a*. A head boss 54*a* is positioned between the first and third ribs 46*a* and 50*a* and the second and fourth ribs 48*a* and 52*a*.

In other forms, the first and third ribs 46*a* and 50*a* may be one monolithic rib without the presence of the head boss 54*a*. Similarly, the second and fourth ribs 48*a* and 52*a* may be one monolithic rib without the presence of the head boss 54*a*. As such, the first and third ribs 46*a* and 50*a* form a single rib that is located above the liner stop mechanism 24*a*. Similarly, the second and fourth ribs 48*a* and 52*a* form a single rib that is located below the liner stop mechanism 24*a*. In yet other forms, the first and third ribs 46*a* and 50*a* may be a single rib and the second and fourth ribs 48*a* and 52*a* may be separate ribs, or vice versa. The second outer cylinder block wall 42 also includes similar first and second ribs as described with respect to the first outer cylinder block wall 40 therefore for the sake of brevity these will not be described again.

The first outer cylindrical block wall 40 includes additional first and second ribs similar to first and second ribs 46*a* and 48*a* for each of the remaining cylinder bores 20*b*-20*f*. The first outer cylindrical block wall 40 includes additional third and fourth ribs similar to third and fourth ribs 50*a* and 52*a* for each of the remaining cylinder bores 20*b*-20*f*. The additional first, second, third and fourth ribs will not be described for the sake of brevity. As illustrated in FIG. 2, the first outer cylindrical block wall 40 includes a first rib 46*c* and a second rib 48*c* similar to first and second ribs 46*a* and 48*a*, respectively.

The first, second, third, and fourth ribs 46*a*, 48*a*, 50*a*, and 52*a* generally follow the circumference of cylinder bore 20*a* or the liner that would be installed therein. The first rib 46*a* is placed above the liner stop mechanism 24*a* and the second rib 48*a* is positioned below the liner stop mechanism 24*a*, with a space there between in the direction of the cylindrical axis Y. The first and second ribs 46*a* and 48*a* act to reduce rotation of a liner seat of a liner installed in the cylinder bore 20*a* and reduce the propensity of the liner to buckle under loads in the direction of a liner axis, or due to loads from cylinder pressure or thermal expansion. The first and second ribs 46*a* and 48*a* also act to reduce rotation or expansion of a liner wall of the liner, where the liner is in contact with the engine block 10 due to press-fit, or transitional fits which typically close under thermal or pressure related expansion.

Figure 6:
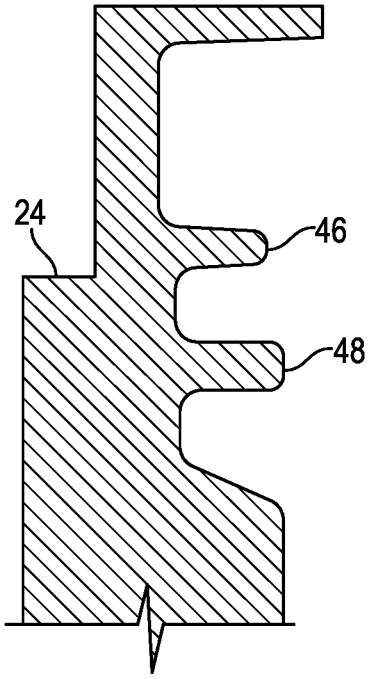
FIG. 6 is a partial cross-sectional view of one embodiment illustrating a first rib positioned closer to a liner stop mechanism than a second rib of the present disclosure.
Figure 7:
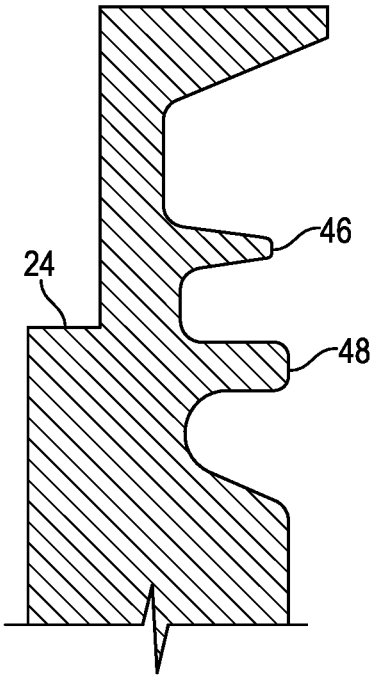
FIG. 7 is a partial cross-sectional view of one embodiment illustrating the second rib positioned closer to a liner stop mechanism than the first rib of the present disclosure.

In one form, the first rib 46 *a* and the third rib 50 *a* are positioned closer to the liner stop mechanism 24 *a* than the second rib 48 *a* and the fourth rib 52 *a* as measured relative to the cylindrical axis Y. Illustrated in FIG. 6 is an embodiment that illustrates the first rib 46 positioned closer to the liner stop mechanism 24 than the second rib 48. In another form, the second rib 48 *a* and fourth rib 52 *a* are positioned closer to the liner stop mechanism 24 *a* than the first rib 46 *a* and the third rib 50 *a* as measured relative to the cylindrical axis Y. Illustrated in FIG. 7 is an embodiment that illustrates the second rib 48 is positioned closer to the liner stop mechanism 24 than the first rib 46. In yet another embodiment, the first, second, third, and fourth ribs 46 *a*, 48 *a*, 50 *a*, and 52 *a* are positioned equidistant from the liner stop mechanism 24 *a* as measured relative to the cylindrical axis Y.

The first rib 46*a* has a first width W1 and the second rib 48*a* has a second width W2 wherein the first rib 46*a* and the second rib 48*a* extend in a direction of the cylindrical axis Y of the cylinder bore 20*a*. In one form, the first width W1 and the second width W2 are the same, in other forms they are different. The first rib 46*a* has a first height H1 and the second rib 48*a* has a second height H2 such that the first and the second ribs 46*a* and 48*a* extend in a direction perpendicular to the cylindrical axis Y of the cylinder bore 20*a*. The third rib 50*a* is similar to the first rib 46*a*, and the fourth rib 52*a* is similar to the second rib 48*a*.

The unique configuration of the first, second, third, and fourth ribs 46*a*, 48*a*, 50*a*, and 52*a* of the first outer cylinder block wall 40 and the corresponding ribs on the second outer cylinder block wall 42 that surround or partially surround the wet cylinder liner in the cylinder bore 20*a* beneficially reduce deformation or distortion of the wet cylinder liner under installation and operating conditions. The first, second, third, and fourth ribs 46*a*, 48*a*, 50*a*, and 52*a* of the first outer cylinder block wall 40 and the corresponding ribs on the second outer cylinder block wall 42 also reduce engine oil consumption and can apply on top, mid or bottom stop liner configurations. Moreover the first, second, third, and fourth ribs 46*a*, 48*a*, 50*a*, and 52*a* do not add too much weight or cost to manufacture. The first, second, third, and fourth ribs 46*a*, 48*a*, 50*a*, and 52*a* are also easy to manufacture for gray iron block casting.

As is evident from the figures and text presented above, a variety of aspects of the present disclosure are contemplated.

Various aspects of the present application are contemplated. According to one aspect, an apparatus comprising an engine block for an internal combustion engine, the engine block having a cylinder bore surrounded by a cylinder bore wall, the cylinder bore wall including a liner stop mechanism configured to locate a liner in the cylinder bore, the engine block having an outer cylinder block wall that surrounds at least a portion of the cylinder bore wall, the outer cylinder block wall including a first rib positioned above the liner stop mechanism and a second rib positioned below the liner stop mechanism relative to a cylindrical axis of the cylinder bore.

In one embodiment, the first rib is positioned closer to the liner stop mechanism than the second rib.

In one embodiment, the second rib is positioned closer to the liner stop mechanism than the first rib.

In one embodiment, the first rib and the second rib are positioned equidistant from the liner stop mechanism.

In one embodiment, the first rib has a first width and the second rib has a second width, the first and the second ribs extend in a direction of the cylindrical axis of the cylinder bore. In a refinement of this embodiment, the first width and the second width are the same.

In one embodiment, the first rib has a first height and the second rib has a second height, the first and the second ribs extend in a direction perpendicular to the cylindrical axis of the cylinder bore.

In one embodiment, the outer cylinder block wall includes a first outer cylinder block wall and a second outer cylinder block wall, and each of the first and the second outer cylinder block walls includes the first and second ribs.

In one embodiment, the cylinder bore includes a mid-portion that spans between an upper end and a lower end, the liner stop mechanism being located near the upper end of the cylinder bore.

In one embodiment, the cylinder bore includes a mid-portion that spans between an upper end and a lower end, the liner stop mechanism being located in the mid-portion of the cylinder bore.

In one embodiment, the cylinder bore includes a mid-portion that spans between an upper end and a lower end, the liner stop mechanism being located near the lower end of the cylinder bore.

In one embodiment, further comprises a liner assembled in the cylinder bore.

According to another aspect, an apparatus comprising an engine block for an internal combustion engine, the engine block having at least one cylinder bore surrounded by a cylinder bore wall, the cylinder bore wall including a liner stop mechanism configured to locate a liner in the cylinder bore, the engine block having an outer cylinder block wall with a first rib and a second rib arranged to straddle the liner stop mechanism exteriorly of the cylinder bore wall.

In one embodiment, the first rib is positioned closer to the liner stop mechanism than the second rib.

In one embodiment, the second rib is positioned closer to the liner stop mechanism than the first rib.

In one embodiment, the first rib and the second rib are positioned equidistant from the liner stop mechanism.

In one embodiment, the first rib has a first width and the second rib has a second width, the first and the second ribs extend in a direction of the cylindrical axis of the cylinder bore.

In one embodiment, the first rib has a first height and the second rib has a second height, the first and the second ribs extend in a direction perpendicular to the cylindrical axis of the cylinder bore.

In one embodiment, the at least one cylinder bore includes a plurality of cylinder bores arranged in line, each of the cylinder bores having a set of the first and second ribs wherein a first set of the first and second ribs extend towards an adjacent set of the first and second ribs.

In one embodiment, the outer cylinder block wall includes a first outer cylinder block wall and a second outer cylinder block wall, and each of the first and the second outer cylinder block walls includes the first and second ribs.

In one embodiment, the cylinder bore includes a mid-portion that spans between an upper end and a lower end, the liner stop mechanism being located near the upper end of the cylinder bore.

In one embodiment, the cylinder bore includes a mid-portion that spans between an upper end and a lower end, the liner stop mechanism being located in the mid-portion of the cylinder bore.

In one embodiment, the cylinder bore includes a mid-portion that spans between an upper end and a lower end, the liner stop mechanism being located near the lower end of the cylinder bore.

In one embodiment, further comprises a liner assembled in the cylinder bore.

In one embodiment, the first rib includes two ribs and the second rib includes two ribs.

In the above description, certain relative terms may be used such as "up," "down," "upper," "lower," "horizontal," "vertical," "left," "right," "proximal," "distal," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In some instances, the benefit of simplicity may provide operational and economic benefits and exclusion of certain elements described herein is contemplated as within the scope of the invention herein by the inventors to achieve such benefits. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an engine block for an internal combustion engine, the engine block having a cylinder bore surrounded by an inner cylinder bore wall, the inner cylinder bore wall having a mid-portion that spans between an upper end and a lower end of the inner cylinder bore wall, the mid-portion including a liner stop mechanism positioned a distance from the upper end of the inner cylinder bore wall, the liner stop mechanism locates and supports a liner in the cylinder bore, the engine block having an outer cylinder block wall that surrounds at least a portion of the cylinder bore wall, the outer cylinder block wall includes a first outer cylinder block wall and a second outer cylinder block wall, each of the first and the second outer cylinder block walls includes a first rib positioned above the liner stop mechanism and a second rib positioned below the liner stop mechanism relative to a cylindrical axis of the cylinder bore, wherein the first rib is located below the upper end of the inner cylinder bore wall and the second rib is located above the lower end of the inner cylinder bore wall, wherein each of the first and the second outer cylinder block walls includes a head boss positioned between the first ribs and the second ribs.

2. The apparatus of claim 1, wherein the first rib is positioned closer to the liner stop mechanism than the second rib.

3. The apparatus of claim 1, wherein the second rib is positioned closer to the liner stop mechanism than the first rib.

4. The apparatus of claim 1, wherein the first rib and the second rib are positioned equidistant from the liner stop mechanism.

5. The apparatus of claim 1, wherein the first rib has a first width and the second rib has a second width, the widths of the first and the second ribs extend in a direction of the cylindrical axis of the cylinder bore, and the first width and the second width are the same.

6. The apparatus of claim 1, wherein the first rib has a first height and the second rib has a second height, the heights of the first and the second ribs extend in a direction perpendicular to the cylindrical axis of the cylinder bore.

7. The apparatus of claim 1, wherein the liner stop mechanism is located near the upper end of the cylinder bore.

8. The apparatus of claim 1, wherein the liner stop mechanism is located near the lower end of the cylinder bore.

9. The apparatus of claim 1, wherein each of the first ribs includes two ribs and each of the second ribs includes two ribs.

10. An apparatus comprising:

an engine block for an internal combustion engine, the engine block having at least one cylinder bore surrounded by an inner cylinder bore wall, the inner cylinder bore wall having a mid-portion that spans between an upper end and a lower end of the inner cylinder bore wall, the mid-portion including a liner stop mechanism positioned away from the upper end of the inner cylinder bore wall, the liner stop mechanism locates and supports a liner in the cylinder bore, the engine block having an outer cylinder block wall with a first rib and a second rib arranged to straddle the liner stop mechanism exteriorly of the inner cylinder bore wall, wherein the first rib is located below the upper end of the inner cylinder bore wall and the second rib is located above the lower end of the inner cylinder bore wall, wherein the outer cylinder block wall includes a head boss positioned between the first rib and the second rib, and the first rib includes two ribs and the second rib includes two ribs.

11. The apparatus of claim 10, wherein the first rib is positioned closer to the liner stop mechanism than the second rib.

12. The apparatus of claim 10, wherein the second rib is positioned closer to the liner stop mechanism than the first rib.

13. The apparatus of claim 10, wherein the first rib and the second rib are positioned equidistant from the liner stop mechanism.

14. The apparatus of claim 10, wherein the first rib has a first width and the second rib has a second width, the widths of the first and the second ribs extend in a direction of the cylindrical axis of the cylinder bore, and the first width and the second width are the same.

15. The apparatus of claim 10, wherein the at least one cylinder bore includes a plurality of cylinder bores arranged in line, each of the cylinder bores having a set of the first and second ribs wherein a first set of the first and second ribs extend towards an adjacent set of the first and second ribs.

16. The apparatus of claim 10, wherein the liner stop mechanism is located near the upper end of the cylinder bore.

17. The apparatus of claim 10, further comprising:

the liner assembled in the cylinder bore wherein the liner stop mechanism engages with the liner to retain the liner in the cylinder bore.

18. The apparatus of claim 10, wherein the outer cylinder block wall includes a first outer cylinder block wall and a second outer cylinder block wall, and each of the first and the second outer cylinder block walls includes the first ribs and the second ribs.

* * * * *